United States Patent [19]

Floyd

[11] Patent Number: 5,050,744

[45] Date of Patent: Sep. 24, 1991

[54] UNIVERSAL TACK TREE

[76] Inventor: Glen C. Floyd, P.O. Box 82, Chester, Id. 83421-0082

[21] Appl. No.: 462,748

[22] Filed: Jan. 10, 1990

[51] Int. Cl.[5] ..... A47F 7/00

[52] U.S. Cl. ..... 211/13; 54/84; 211/87

[58] Field of Search ..... 211/13, 86, 87, 90; 54/84

[56] References Cited

U.S. PATENT DOCUMENTS

| | | | |
|---|---|---|---|
| 378,201 | 2/1888 | Jacoby | 211/87 X |
| 2,760,746 | 8/1956 | Botolfsen | 211/13 X |
| 2,809,755 | 10/1957 | Martorello | 211/13 |
| 2,941,706 | 6/1960 | Slater | 211/90 X |
| 2,953,252 | 9/1960 | Koontz | 211/13 |
| 3,305,101 | 2/1967 | Mills | 211/13 X |
| 3,688,912 | 9/1972 | Wilmoth | 211/13 X |
| 3,780,971 | 12/1973 | DeFilipps | 54/84 X |
| 4,421,238 | 12/1983 | Patton | 211/87 |
| 4,432,459 | 2/1984 | Coldren | 211/13 |
| 4,541,535 | 9/1985 | Bartholomew | 211/96 |
| 4,768,656 | 9/1988 | Hartley | 211/13 |

*Primary Examiner*—David L. Talbott

*Assistant Examiner*—Daniel Hulseberg

*Attorney, Agent, or Firm*—Fleit, Jacobson, Cohn, Price, Holman & Stern

[57] ABSTRACT

A horizontal, elongated support structure is provided having a transverse cross sectional shape generally similar to a truncated equilateral triangle and mounting structure is provided at one end for support of the elongated structure from a vertical support surface and with the support structure disposed generally normal to the surface. The elongated support structure may have a saddle disposed thereover for support of the saddle therefrom during periods of non use and a majority of the upwardly facing surfaces of the support structure are reticulated for free passage of drying air therethrough. In addition, the longitudinal center of the support structure defines a downwardly opening space also opening outwardly of the end of the support structure remote from the mounting structure therefor and a horizontal support arm is mounted within the space and supported only at its end adjacent the mounting structure to thereby enable saddle pads and/or blankets to be draped over the arm from the outwardly projecting end of the support structure.

13 Claims, 2 Drawing Sheets

UNIVERSAL TACK TREE

BACKGROUND OF THE INVENTION

1. Field of the Invention

The present invention relates to a horizontally elongated structure designed to be supported at one end and to project endwise outwardly from an elevated mount portion therefor at the other end. The elongated structure includes a transverse cross section having the shape of a truncated equilateral triangle and may have a saddle disposed thereover during periods of non-use of the latter for air drying of the undersurfaces of the saddle. In addition, the structure opens downwardly and has a longitudinally extending horizontal bar mounted therein supported only at the aforementioned one end of the structure and the bar or support arm defined thereby may have a saddle blanket or pad draped thereover for air drying.

Tack rooms are used to store various forms of tack and in many instances, especially during rainy or hot weather, the saddle, saddle blanket and pad as well as other tack removed from a horse are damp with rain or sweat and must be stored until the next period of usage thereof in a manner facilitating rapid air drying and it is to this end that the tack tree of the instant invention has been designed.

2. Description of Related Art

Various different forms of saddle racks and other devices including some of the structure and operation of the instant invention heretofor have been provided. Examples of these previously known structures are disclosed in U.S. Pat. Nos. 2,809,755; 4,421,238; 4,423,459 and 4,541,535. However, these previously known devices do not include the overall structural and operational features of the instant invention.

SUMMARY OF THE INVENTION

The saddle tree of the instant invention comprises an elongated support which has a cross sectional shape generally that of a truncated equilateral triangle, although the base angles defined by the cross sectional outline of the tree are at least slightly less than 60° and more closely approximating 45°.

The tack tree includes the necessary frame work, but a majority of the exposed surfaces thereof are constructed of expanded metal for facilitating air drying of saddles, saddle blankets and pads as well as other pieces of tack.

The main object of this invention is to provide a tack tree (primarily designed for removable support from a vertical wall structure) for supporting a saddle during periods of non-use.

Another object of this invention is to provide a tack tree also constructed in a manner whereby saddle blankets and pads may be supported therefrom for air drying.

Still another important object of this invention is to provide a tack tree defining shelf areas upon which smaller pieces of tack and other accessories may be placed in close proximity to and within the confines of the undersurfaces of a saddle supported from the tree.

Yet another important object of this invention is to provide a tack tree from which both Western and English saddles may be supported during periods of non-usage.

A final object of this invention to be specifically enumerated herein is to provide a saddle tree in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
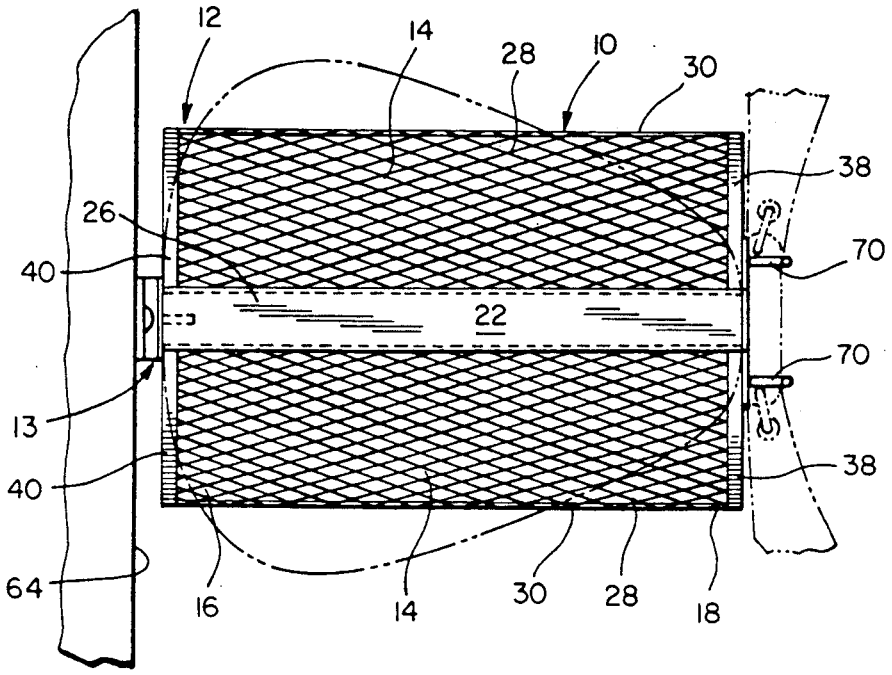
FIG. 1 is a top plan view of the saddle tree of the instant invention, the outline of a saddle and other pieces of tack supported therefrom being illustrated in phantom lines.

Referring now more specifically to the drawings, the numeral 10 generally designates the tack tree of the instant invention. The tree 10 incorporates an elongated support structure 12 having a cross sectional shape generally similar to that of a truncated equilateral triangle. In addition, the tack tree 10 incorporates a mounting bracket referred to in general by the reference numeral 13 by which the support structure 12 may be removably supported from a vertical support surface such as a wall structure. Also, as will be hereinafter more fully set forth, the support structure 12 is removably supported from the mounting bracket 13 and may be inverted relative thereto.

The support structure 12 incorporates a pair of laterally spaced apart upwardly convergent opposite side longitudinal panels 14 having first and second ends 16 and 18. The upper longitudinal marginal portions 20 of the panels 14 are horizontally spaced apart and interconnected by a horizontal longitudinally extending bridging member 22 disposed therebetween. The bridging member 22 comprises an inverted channel member including opposite side longitudinally extending vertical flanges 24 interconnected along their upper marginal portions by a horizontal bight portion 26 extending and connected therebetween, the upper longitudinal marginal portions 20 of the panels 14 being secured to opposite sides of the inverted channel member 22 adjacent the intersection of the flanges 24 and the bight portion 26.

The lower longitudinal marginal portions 28 of the panels 14 terminate downwardly in downwardly angled extensions 30 which in turn terminate downwardly in generally horizontally inwardly directed panel portions 32 and the inner extremities of the panel portions 32 terminate in upwardly directed inner panels 34. Corresponding panels 14, extensions 30, inwardly direction panel portions 32 and inner panels 34 are integrally formed.

At the front end of the support structure 12, the bight portion 22 includes a downward extension 36 closing the front end of the channel shaped bridging member 22 and the front end of the support structure 12 further includes a pair of laterally spaced apart mirror image triangular frames 38 constructed of angle members and to whose inner surfaces the corresponding forward ends of the panels 14, the extensions 30, the inwardly directed panel portions 32 and the inner panels 34 are secured, the frames 38 at the front end of the support structure 22 being free of interconnections extending therebetween.

The rear end of the support structure 12 includes generally similar laterally spaced apart and oppositely directed triangular frames 40 constructed of angle members and the frames 40 have the rear ends of the panels 14, the extensions 30, the inwardly directed panel portions 32 and the inner panels 34 secured thereto.

In addition, the rear end of the support structure 12 includes a depending forwardly opening channel member 44 including a bight portion 46 extending between and interconnecting a pair of vertically disposed and forwardly projecting flanges 48 and mid-height portions of the flanges 48 are interconnected by a brace 50 extending and secured therebetween. The rear end of a horizontally elongated and extending support arm 52 is supported from the brace 50 and the forward end of the support arm 52 is disposed within the confinds of the downwardly opening support structure 22 and terminates a spaced distance rearward of the front end of the support structure 12. Only the rear end of the support arm 52 is attached to any other portion of the support structure 12 and the support arm 52 is spaced between the inner panels 48 and appreciably below the bridging member 22.

Figure 5:
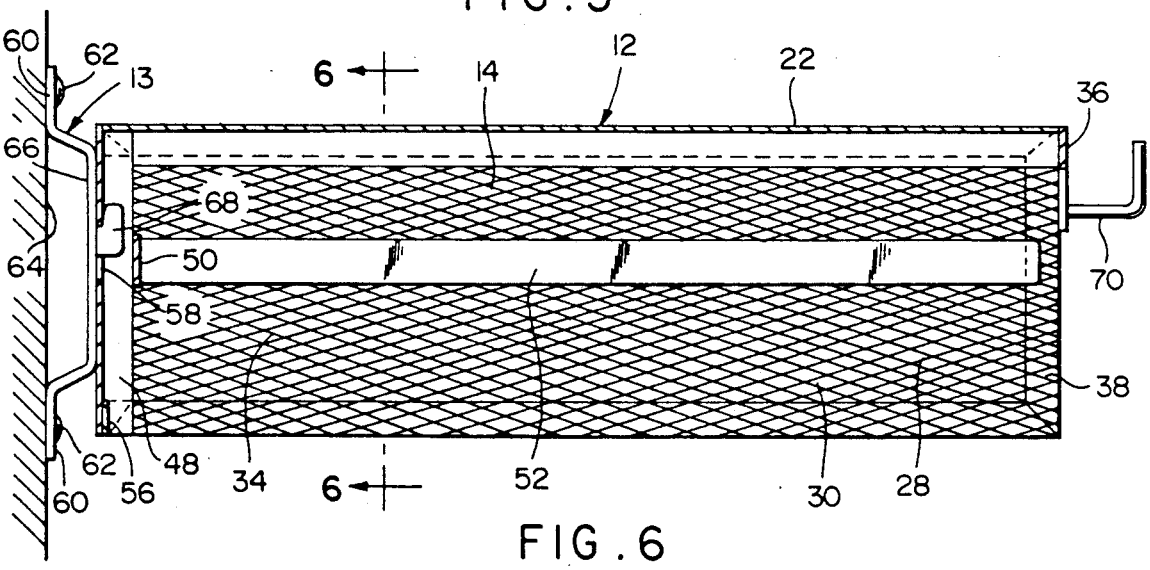
FIG. 5 is an enlarged longitudinal vertical sectional view taken substantially upon the plane indicated by the section line 5—5 of FIG. 4.
Figure 6:
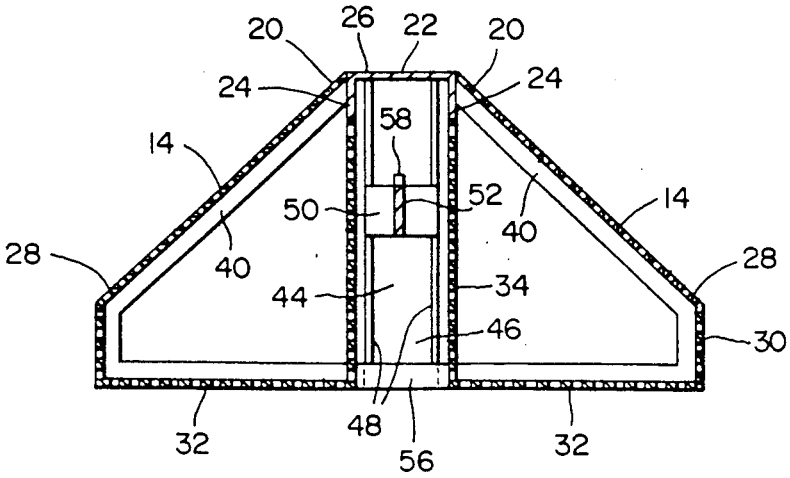
FIG. 6 is a transverse vertical sectional view taken substantially upon the plane indicated by the section line 6—6 of FIG. 5.

From FIGS. 5 and 6 of the drawings, it may be seen that a brace 56 extends between the lower marginal portions of the rear frames 40 and the bight portion 46 and that the bight portion 46 includes a vertically elongated mid-height opening 58 formed therethrough which projects slightly above the upper extremity of the brace 50. Inasmuch as the brace 50 is secured between the free longitudinal marginal edges of the flanges 48, it is spaced appreciably forward of the bight portion 46.

The mounting bracket 13 includes co-planar upper and lower ends 60 through which fasteners 62 may be secured for securing the mounting bracket 13 to a vertical support structure 64 and the mounting bracket 13 further includes a laterally offset (forwardly) mid portion 66 having a forwardly projecting L-shaped hook 68 supported therefrom, the hook 68 being receivable through the opening 58. Accordingly, the support structure 22 may be removably supported from the mounting bracket 13. Further, the support structure 22 may be removably supported from the mounting bracket 13 in an inverted position.

The forward end of the support structure 12 includes forwardly projecting and upwardly opening hooks 70 supported therefrom on opposite sides of the inner panels 34 and various different forms of tack such as halters, bridles and other accessories may be removably supported from the hooks 70. Further, as may be seen from FIGS. 2 and 3, a saddle 72 may be placed over and supported from the upwardly facing surfaces of the support structure 22. Also, a saddle blanket and/or pad may be supported from the support arm 52 and readily removed therefrom whenever desired.

Figure 2:
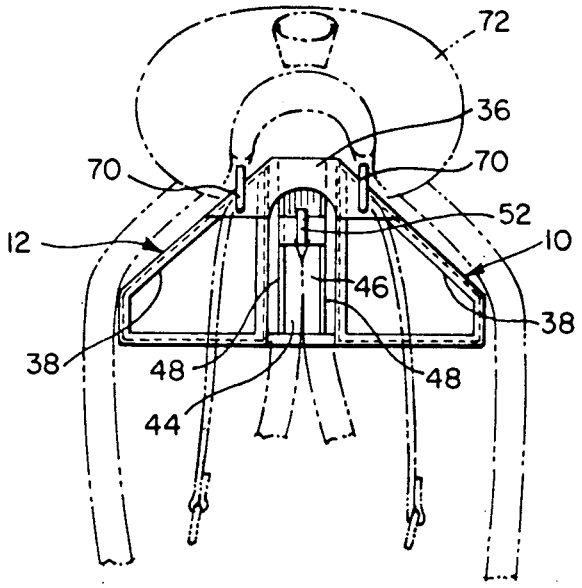
FIG. 2 is a front elevational view of the tack tree.
Figure 3:
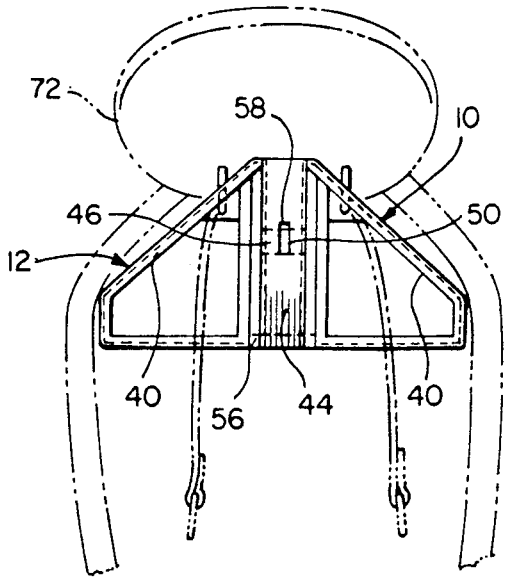
FIG. 3 is a rear elevational view of the tack tree.
Figure 4:
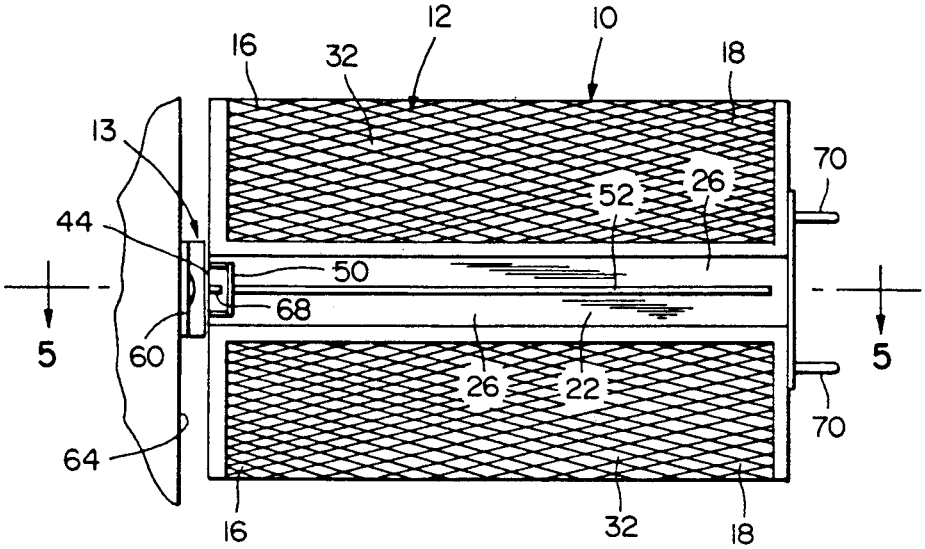
FIG. 4 is a bottom plan view of the tack tree.

From FIGS. 2 and 3 of the drawings, it may be seen that the saddle 72 is supported from the support structure 12 in a manner facilitating the free movement of air beneath the under surfaces of the saddle 72. In this manner, the undersurfaces of the saddle 72 may be readily air dried during periods of non-use. In addition, those areas of the interior of the support structure 12 disposed immediately above the inwardly directed panel portions 32 define support shelves upon which various articles and accessories such as brushes, combs and shoes may be supported.

In addition to the support structure being invertibly removably supported from the mounting bracket 13, it is to be noted that the mounting bracket itself may be mounted in various different locations. For example, the bracket 13 may be mounted within a barn, within a horse trailer or truck, within a pick-up truck and in many other locations in which it may be desired to temporarily store a saddle and other pieces of tack. Further, the intermediate height portion 66 and hook 68 of the mounting bracket 13 may be readily incorporated into the upper portion of a floor stand having horizontally directed foot portions disposed beneath the support structure 22. Accordingly, the support structure 22 comprises a very versatile piece of tack room equipment.

These together with other objects and advantages which will become subsequently apparent reside in the details of construction and operation as more fully hereinafter described and claimed, reference being had to the accompanying drawings forming a part hereof, wherein like numerals refer to like parts throughout.

What is claimed as new is as follows:

1. A tack tree for temporary storage of a saddle, saddle pads and blankets as well as other accessories, said tack tree including horizontally elongated structure incorporating horizontally elongated, opposite side and upwardly convergent panels extending longitudinally of said structure and including upper and lower marginal portions, said upper marginal portions being spaced apart and joined by an elongated horizontal bridging member extending longitudinally of said structure and disposed between said upper marginal portions, said elongated structure including first and second opposite ends, said first end of said elongated structure including a vertically elongated mount portion having upper and lower ends, said mount portion upper end being anchored relative to the end of said bridging member corresponding to said first end of said elongated structure and with said mount portion extending downwardly from said bridging member, horizontally elongated brace means extending between and interconnecting the ends of said lower marginal portions at said first end of said elongated structure and the lower end of said mount portion, a horizontally elongated support arm extending longitudinally of said structure and including first and second terminal ends corresponding to said first and second ends of said elongated structure, respectively, said support arm being spaced below said bridging member and above a horizontal plane containing said lower marginal portions and having said first terminal end thereof supported from said mount portion intermediate the upper and lower ends thereof, at least a major portion of the length of said support arm forward of said first terminal end and being spaced from and free of connections with the remainder of said elongated structure, each of said first and second ends of said elongated structure including a pair of oppositely directed generally right triangular frames including spaced apart height sides, upwardly convergent inclined slant height sides and base sides extending in opposite directions from said height sides, said panels including opposite end margins anchored relative to said slant height sides, the upper ends of said slant height sides being anchored relative to the corresponding ends of said bridging member and the adjacent ends of said base sides of said frame at said first end of said elongated structure being braced relative to the lower end of said vertically elongated mount portion.

2. The tack tree of claim 1 wherein said second terminal end of said support arm is recessed inwardly of said second end of said elongated structure.

3. The tack tree of claim 1 wherein said upwardly convergent panels define spaced apart air circulation openings therethrough.

4. The tack tree of claim 3 wherein said upwardly convergent panels comprise expanded metal panels.

5. The tack tree of claim 2 wherein the adjacent ends of the slant height and base sides of each of said frames are joined by a short upstanding frame member extending therebetween, said lower marginal portions of said upwardly convergent panels including downwardly angled extensions having opposite end margins anchored relative to said upstanding frame members.

6. The tack tree of claim 5 wherein said downwardly angled extensions terminate downwardly in generally horizontally inwardly directed panel portions including opposite end margins anchored relative to said base sides.

7. The tack tree of claim 6 wherein said slant height sides, upstanding frame members and base frame member sides are formed of angle members including outer flange portions overlying the outer sides of the corresponding end margins of said upwardly convergent panels, downwardly angled extensions and inwardly directed panel portions, respectively.

8. The tack tree of claim 7 wherein said second terminal end of said support arm is recessed inwardly of said second end of said elongated structure.

9. The tack tree of claim 8 wherein said upwardly convergent panels define spaced apart air circulation openings therethrough.

10. The tack tree of claim 9 wherein said upwardly convergent panels comprise expanded metal panels.

11. A tack tree for temporary storage of a saddle, saddle pads and blankets as well as other accessories, said tack tree including horizontally elongated structure incorporating horizontally elongated, opposite side and upwardly convergent panels extending longitudinally of said structure and including upper and lower marginal portions, said upper marginal portions being spaced apart and joined by an elongated horizontal bridging member extending longitudinally of said structure and disposed between said upper marginal portions, said elongated structure including first and second opposite ends, said first end of said elongated structure including a vertically elongated mount portion having upper and lower ends, said mount portion upper end being anchored relative to the end of said bridging member corresponding to said first end of said elongated structure and with said mount portion extending downwardly from said bridging member, horizontally elongated brace means extending between and interconnecting the ends of said lower marginal portions at said first end of said elongated structure and the lower end of said mount portion, a horizontally elongated support arm extending longitudinally of said structure and including first and second terminal ends corresponding to said first and second ends of said elongated structure, respectively, said support arm being spaced below said bridging member and above a horizontal plane containing said lower marginal portions and having said first terminal end thereof supported from said mount portion intermediate the upper and lower ends thereof, at least a major portion of the length of said support arm forward of said first terminal end and being spaced from said free of connections with the remainder of said elongated structure, each of said first and second ends of said elongated structure including a pair of oppositely directed generally right triangular frames including spaced apart height sides, upwardly convergent inclined slant height sides and base side extending in opposite directions from said height sides, said panels including opposite end margins anchored relative to said slant height sides, the upper ends of said slant height sides being anchored relative to the corresponding ends of said bridging member and the adjacent ends of said base sides of said frames at said first end of said elongated structure being braced relative to the lower end of said vertically elongated mount portion, the adjacent ends of the slant height and base sides of each of said frames being joined by a short upstanding frame member extending therebetween, said lower marginal portions of said upwardly convergent panels including downwardly angled extensions having opposite end margins anchored relative to said upstanding frame members, said downwardly angled extensions terminating downwardly in generally horizontally inwardly directed panel portions including opposite end margins anchored relative to said base sides, said inwardly directed panel portion terminating inwardly in upwardly directed inner panels including opposite end margins anchored relative to the corresponding height sides.

12. The tack tree of claim 11 wherein said support arm is spaced between the upper end portions of said height sides and inner panels.

13. The tack tree of claim 12 wherein the right triangular frames at said second end of said elongated structure include outwardly projecting and upwardly opening article support hooks supported therefrom adjacent the intersections between the height and slant height sides thereof.

* * * * *